US006615174B1

(12) United States Patent
Arslan et al.

(10) Patent No.: US 6,615,174 B1
(45) Date of Patent: Sep. 2, 2003

(54) VOICE CONVERSION SYSTEM AND METHODOLOGY

(75) Inventors: Levent Mustafa Arslan, Istanbul (TR); David Thieme Talkin, Los Gatos, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/355,267

(22) PCT Filed: Jan. 27, 1998

(86) PCT No.: PCT/US98/01538

§ 371 (c)(1),
(2), (4) Date: Feb. 22, 2000

(87) PCT Pub. No.: WO98/35340

PCT Pub. Date: Aug. 13, 1998

Related U.S. Application Data

(60) Provisional application No. 60/036,227, filed on Jan. 27, 1997.

(51) Int. Cl.[7] ..... G10L 21/00

(52) U.S. Cl. ..... 704/270; 704/272; 704/217; 704/223

(58) Field of Search ..... 704/200, 203, 704/205, 206, 217–224, 261, 270, 272, 276, 278

(56) References Cited

U.S. PATENT DOCUMENTS

| | | | | | |
|---|---|---|---|---|---|
| 5,113,449 | A | * | 5/1992 | Blanton et al. | 704/261 |
| 5,327,521 | A | | 7/1994 | Savic et al. | 704/272 |
| 5,704,006 | A | | 12/1997 | Iwahashi | 704/222 |
| 6,161,091 | A | * | 12/2000 | Akamine et al. | 704/207 |

* cited by examiner

*Primary Examiner*—David D. Knepper
(74) *Attorney, Agent, or Firm*—Theodore M. Magee; Westman, Champlin, & Kelly, P.A.

(57) ABSTRACT

A voice conversion system employs a codebook mapping approach to transforming a source voice to sound like a target voice. Each speech frame is represented by a weighted average of codebook entries. The weights represent a perceptual distance of the speech frame and may be refined by a gradient descent analysis. The vocal tract characteristics, represented by a line spectral frequency vector, the excitation characteristics, represented by a linear predictive coding residual, the duration, and the amplitude of the speech frame are transformed in the same weighted-average framework.

30 Claims, 5 Drawing Sheets

VOICE CONVERSION SYSTEM AND METHODOLOGY

RELATED APPLICATIONS

This application claims the benefit of U.S. Provisional Application No. 60/036,227, entitled "Voice Conversion by Segmental Codebook Mapping of Line Spectral Frequencies and Excitation System," filed on Jan. 27, 1997 by Levent M. Arsian and David Talkin, incorporated herein by reference.

FIELD OF THE INVENTION

The present invention relates to voice conversion and, more particularly, to codebook-based voice conversion systems and methodologies.

BACKGROUND OF THE INVENTION

A voice conversion system receives speech from one speaker and transforms the speech to sound like the speech of another speaker. Voice conversion is useful in a variety of applications. For example, a voice recognition system may be trained to recognize a specific person's voice or a normalized composite of voices. Voice conversion as a front-end to the voice recognition system allows a new person to effectively utilize the system by converting the new person's voice into the voice that the voice recognition system is adapted to recognize. As a post processing step, voice conversion changes the voice of a text-to-speech synthesizer. Voice conversion also has applications in voice disguising, dialect modification, foreign-language dubbing to retain the voice of an original actor, and novelty systems such as celebrity voice impersonation, for example, in Karaoke machines.

In order to convert speech from a "source" voice to a "target" voice, codebooks of the source voice and target voice are typically prepared in a training phase. A codebook is a collection of "phones," which are units of speech sounds that a person utters. For example, the spoken English word "cat" in the General American dialect comprises three phones [K], [AE], and [T], and the word "cot" comprises three phones [K], [AA], and [T]. In this example, "cat" and "cot" share the initial and final consonants but employ different vowels. Codebooks are structured to provide a one-to-one mapping between the phone entries in a source codebook and the phone entries in the target codebook.

U.S. Pat. No. 5,327,521 describes a conventional voice conversion system using a codebook approach. An input signal from a source speaker is sampled and preprocessed by segmentation into "frames" corresponding to a speech unit. Each frame is matched to the "closest" source codebook entry and then mapped to the corresponding target codebook entry to obtain a phone in the voice of the target speaker. The mapped frames are concatenated to produce speech in the target voice. A disadvantage with this and similar conventional voice conversion systems is the introduction of artifacts at frame boundaries leading to a rather rough transition across target frames. Furthermore, the variation between the sound of the input speech frame and the closest matching source codebook entry is discarded, leading to a low quality voice conversion.

A common cause for the variation between the sounds in speech and in codebook is that sounds differ depending on their position in a word. For example, the /t/ phoneme has several "allophones." At the beginning of a word, as in the General American pronunciation of the word "top", the /t/ phoneme is an unvoiced, fortis, aspirated, alveolar stop. In an initial cluster with an /s/, as in the word "stop," it is an unvoiced, fortis, unaspirated, alveolar stop. In the middle of a word between vowels, as in "potter," it is an alveolar flap. At the end of a word, as in "pot," it is an unvoiced, lenis, unaspriated, alveolar stop. Although the allophones of a consonant like /t/ are pronounced differently, a codebook with only one entry for the /t/ phoneme will produce only one kind of /t/ sound and, hence, unconvincing output. Prosody also accounts for differences in sound, since a consonant or vowel will sound somewhat different when spoken at a higher or lower pitch, more or less rapidly, and with greater or lesser emphasis.

Accordingly, one conventional attempt to improve voice conversion quality is to greatly increase the amount of training data and the number of codebook entries to account for the different allophones of the same phoneme and different prosodic conditions. Greater codebook sizes lead to increased storage and computational costs. Conventional voice conversion systems also suffer in a loss of quality because they typically perform their codebook mapping in an acoustic space defined by linear predictive coding coefficients. Linear predictive coding is an all-pole modeling of speech and, hence, does not adequately represent the zeroes in a speech signal, which are more commonly found in nasal and sounds not originating at the glottis. Linear predictive coding also has difficulties with higher pitched sounds, for example, women's voices and children's voices.

SUMMARY OF THE INVENTION

There exists a need for a voice conversion system and methodology having improved quality output, but preferably still computationally tractable. Differences in sound due to word position and prosody need to be addressed without increasing the size of codebooks. Furthermore, there is a need to account for voice features that are not well supported by linear predictive coding, such as the glottal excitation, nasalized sounds, and sounds not originating at the glottis.

Accordingly, one aspect of the invention is a method and a computer-readable medium bearing instructions for transforming a source signal representing a source voice into a target signal representing a target voice. The source signal is preprocessed to produce a source signal segment, which is compared with source codebook entries to produce corresponding weights. The source signal segment is transformed into a target signal segment based on the weights and corresponding target codebook entries and post processed to generate the target signal. By computing a weighted average, a composite source voice can be mapped to a corresponding composite target voice, thereby reducing artifacts at frame boundaries and leading to smoother transitions between frame boundaries without having to employ a large number of codebook entries.

In another aspect of the invention, the source signal segment is compared with the source codebook entries as line spectral frequencies to facilitate the computation of the weighted average. In still another aspect of the invention, the weights are refined by a gradient descent analysis to further improve voice quality. In a further aspect of the invention, both vocal tract characteristics and excitation characteristics are transformed according to the weights, thereby handling excitation characteristics in a computationally tractable manner.

Additional needs, objects, advantages, and novel features of the present invention will be set forth in part in the description that follows, and in part, will become apparent upon examination or may be learned by practice of the invention. The objects and advantages of the invention may be realized and obtained by means of the instrumentalities and combinations particularly pointed out in the appended claims.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF THE PREFERRED EMBODIMENT

A method and apparatus for voice conversion is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

HARDWARE OVERVIEW

Figure 1:
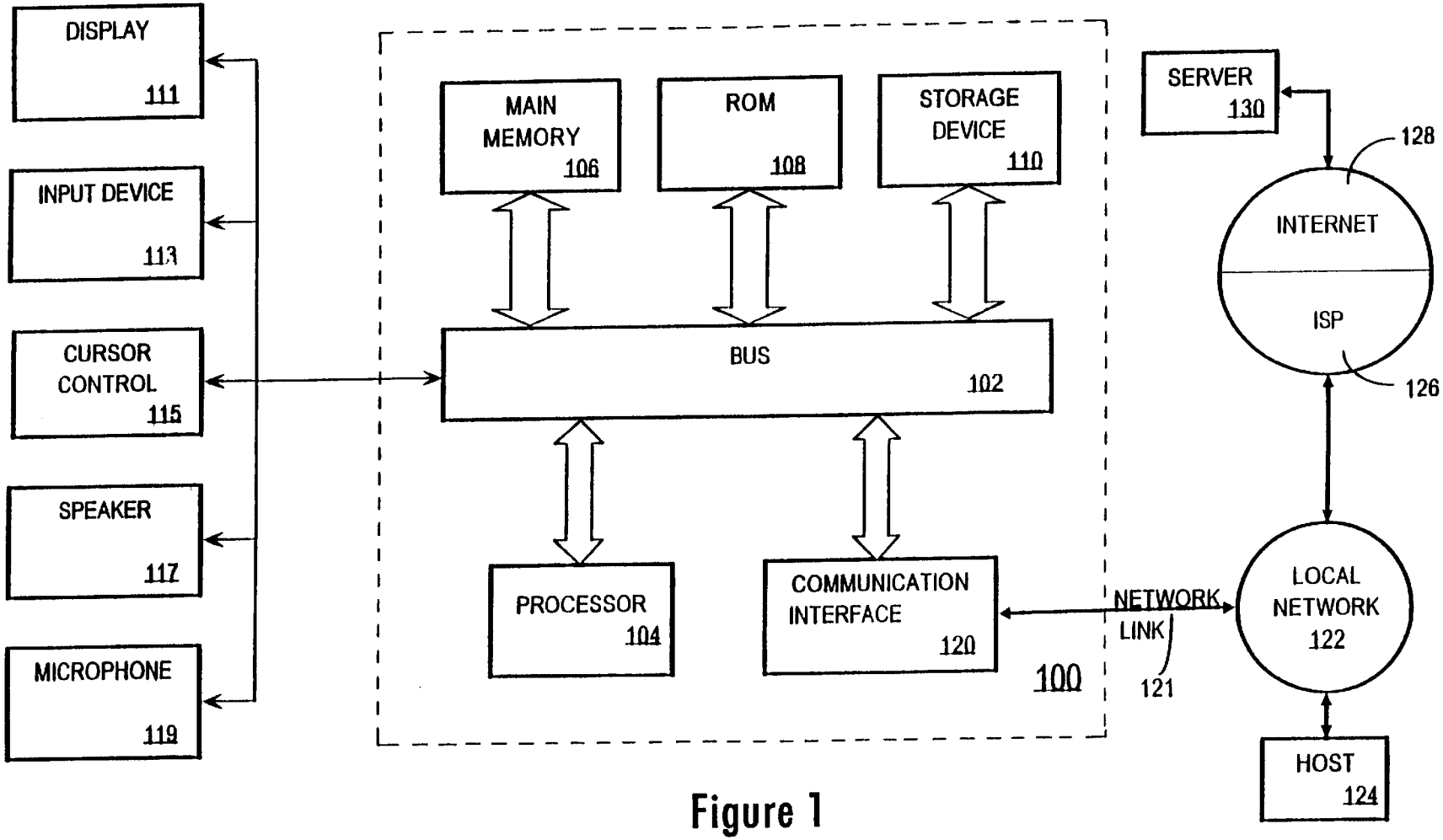
FIG. 1 schematically depicts a computer system that can implement the present invention.

FIG. 1 is a block diagram that illustrates a computer system 100 upon which an embodiment of the invention may be implemented. Computer system 100 includes a bus 102 or other communication mechanism for communicating information, and a processor (or a plurality of central processing units working in cooperation) 104 coupled with bus 102 for processing information. Computer system 100 also includes a main memory 106, such as a random access memory (RAM) or other dynamic storage device, coupled to bus 102 for storing information and instructions to be executed by processor 104. Main memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 111, such as a cathode ray tube (CRT), for displaying information to a computer user. An input device 113, including alphanumeric and other keys, is coupled to bus 102 for communicating information and command selections to processor 104. Another type of user input device is cursor control 115, such as a mouse, a trackball, or cursor direction keys for communicating direction information and command selections to processor 104 and for controlling cursor movement on display 111. This input device typically has two degrees of freedom in two axes, a first axis (e.g., x) and a second axis (e.g., y), that allows the device to specify positions in a plane. For audio output and input, computer system 100 may be coupled to a speaker 117 and a microphone 119, respectively.

The invention is related to the use of computer system 100 for voice conversion. According to one embodiment of the invention, voice conversion is provided by computer system 100 in response to processor 104 executing one or more sequences of one or more instructions contained in main memory 106. Such instructions may be read into main memory 106 from another computer-readable medium, such as storage device 110. Execution of the sequences of instructions contained in main memory 106 causes processor 104 to perform the process steps described herein. One or more processors in a multi-processing arrangement may also be employed to execute the sequences of instructions contained in main memory 106. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 104 for execution. Such a medium may take many forms, including but not limited to, non-volatile media, volatile media, and transmission media. Non-volatile media include, for example, optical or magnetic disks, such as storage device 110. Volatile media include dynamic memory, such as main memory 106. Transmission media include coaxial cables, copper wire and fiber optics, including the wires that comprise bus 102. Transmission media can also take the form of acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 104 for execution. For example, the instructions may initially be borne on a magnetic disk of a remote computer. The remote computer can load the instructions into its dynamic memory and send the instructions over a telephone line using a modem. A modem local to computer system 100 can receive the data on the telephone line and use an infrared transmitter to convert the data to an infrared signal. An infrared detector coupled to bus 102 can receive the data carried in the infrared signal and place the data on bus 102. Bus 102 carries the data to main memory 106, from which processor 104 retrieves and executes the instructions. The instructions received by main memory 106 may optionally be stored on storage device 110 either before or after execution by processor 104.

Computer system 100 also includes a communication interface 120 coupled to bus 102. Communication interface 120 provides a two-way data communication coupling to a network link 121 that is connected to a local network 122. Examples of communication interface 120 include an integrated services digital network (ISDN) card, a modem to provide a data communication connection to a corresponding type of telephone line, and a local area network (LAN)

card to provide a data communication connection to a compatible LAN. Wireless links may also be implemented. In any such implementation, communication interface 120 sends and receives electrical, electromagnetic or optical signals that carry digital data streams representing various types of information.

Network link 121 typically provides data communication through one or more networks to other data devices. For example, network link 121 may provide a connection through local network 122 to a host computer 124 or to data equipment operated by an Internet Service Provider (ISP) 126. ISP 126 in turn provides data communication services-through the world wide packet data communication network, now commonly referred to as the "Internet" 128. Local network 122 and Internet 128 both use electrical, electromagnetic or optical signals that carry digital data streams. The signals through the various networks and the signals on network link 121 and through communication interface 120, which carry the digital data to and from computer system 100, are exemplary forms of carrier waves transporting the information.

Computer system 100 can send messages and receive data, including program code, through the network(s), network link 121, and communication interface 120. In the Internet example, a server 130 might transmit a requested code for an application program through Internet 128, ISP 126, local network 122 and communication interface 118. In accordance with the invention, one such downloaded application provides for voice conversion as described herein. The received code may be executed by processor 104 as it is received, and/or stored in storage device 110, or other non-volatile storage for later execution. In this manner, computer system 100 may obtain application code in the form of a carrier wave.

SOURCE AND TARGET CODEBOOKS

Figure 2:
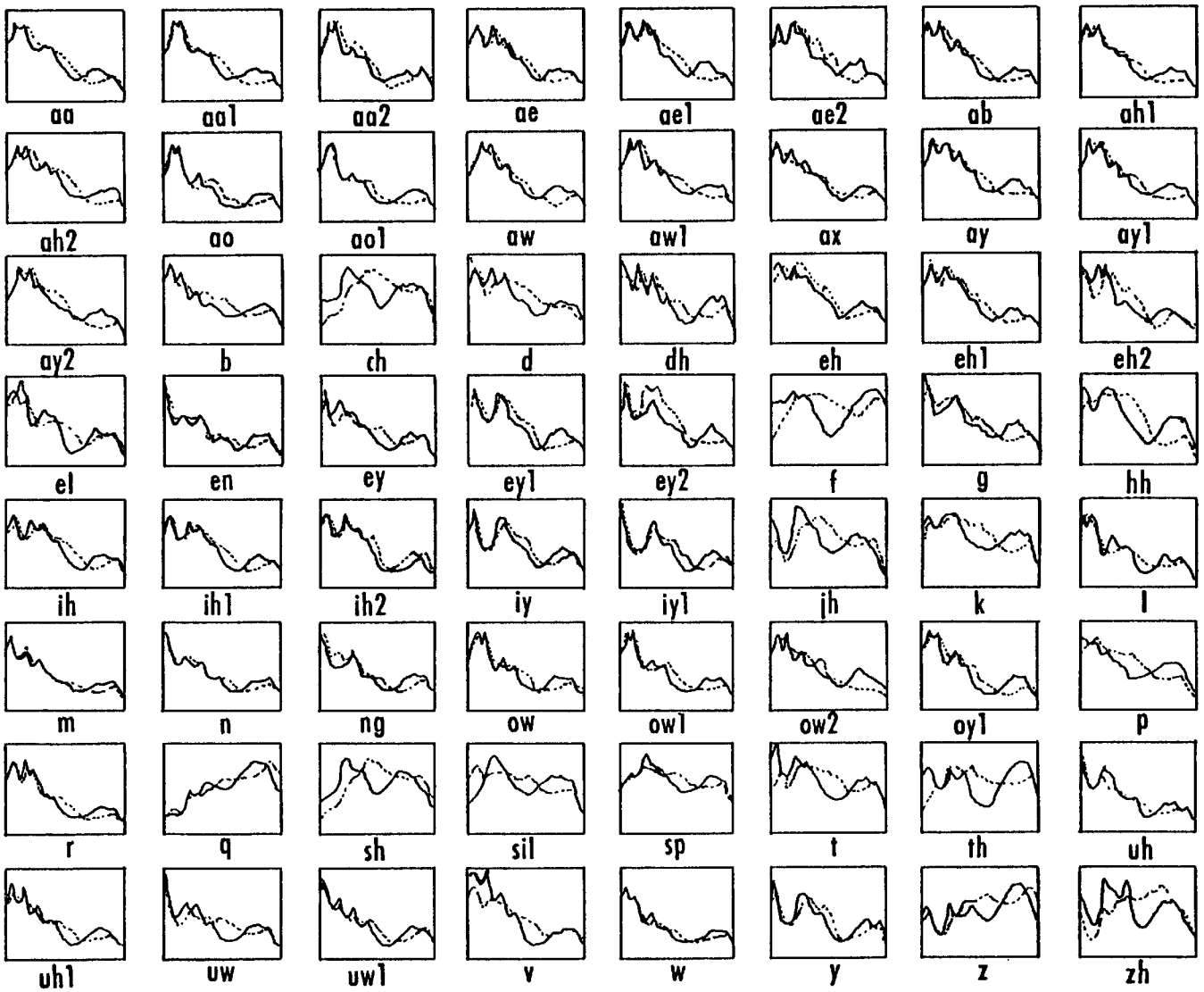
FIG. 2 depicts codebook entries for a source speaker and a target speaker.

In accordance with the present invention, codebooks for the source voice and the target voice are prepared as a preliminary step, using processed samples of the source and target speech, respectively. The number of entries in the codebooks may vary from implementation to implementation and depends on a trade-off of conversion quality and computational tractability. For example, better conversion quality may be obtained by including a greater number of phones in various phonetic contexts but at the expense of increased utilization of computing resources and a larger demand on training data. Preferably, the codebooks include at least one entry for every phoneme in the conversion language. However, the codebooks may be augmented to include allophones of phonemes and common phoneme combinations may augment the codebook. FIG. 2 depicts an exemplary codebook comprising 64 entries. Since vowel quality often depends on the length and stress of the vowel, a plurality of vowel phones for a particular vowel, for example, [AA], [AA1], and [AA2], are included in the exemplary codebook.

The entries in the source codebook and the target codebooks are obtained by recording the speech of the source speaker and the target speaker, respectively, and their speech into phones. According to one training approach, the source and target speakers are asked to utter words and sentences for which an orthographic transcription is prepared. The training speech is sampled at an appropriate frequency such as 16 kHz and automatically segmented using, for example, a forced alignment to a phonetic translation of the orthographic transcription within an HMM framework using Mel-cepstrum coefficients and delta coefficients as described in more detail in C. Wightman & D. Talin, *The Aligner User's Manual*, Entropic Reseach Laboratory, Inc., Washington, D.C., 1994.

Preferably, the source and target vocal tract characteristics in the codebook entries are represented as line spectral frequencies (LSF). In contrast to conventional approaches using linear prediction coefficients (LPC) or formant frequencies, line spectral frequencies can be estimated quite reliably and have a fixed range useful for real-time digital signal processing implementation. The line spectral frequency values for the source and target codebooks can be obtained by first determining the linear predictive coefficients $a_k$ for the sampled signal according to well-known techniques in the art. For example, specialized hardware, software executing on a general purpose computer or microprocessor, or a combination thereof, can ascertain the linear predictive coefficients by such techniques as square-root or Cholesky decomposition, Levinson-Durbin recursion, and lattice analysis introduced by Itakura and Saito. The linear predictive coefficients $a_k$, which are recursively related to a sequence of partial correlation (PARCOR) coefficients, form an inverse filter polynomial, $$A(z) = 1 - \sum_{k=1}^{P} a_k z^{-k},$$

which may be augmented with +1 and −1, to produce following polynomials, wherein the angles of the roots, $w_k$, are the line spectral frequencies:

$$P(z) = (1 - z^{-1}) \prod_{k=1,3,5,\ldots}^{P-1} (1 - 2\cos(w_k z^{-1} + z^{-1})) \quad (1)$$

$$Q(z) = (1 + z^{-1}) \prod_{k=2,4,6,\ldots}^{P-1} (1 - 2\cos(w_k z^{-1} + z^{-1})) \quad (2)$$

Preferably, a plurality of samples are taken for each source and target codebook entry and averaged or otherwise processed, such as taking the median sample or the sample closest to the mean, to produce a source centroid vector $S_i$ and target vector centroid $T_i$, respectively, where $i \in 1 \ldots L$, and L is size of the codebook. Line spectral frequencies can be converted back into linear predictive coefficients by generating a sequence of coefficients via polynomial P(z) and Q(z) and, thence, the linear predictive coefficients $a_k$.

Thus, the source codebook and the target codebook have corresponding entries containing speech samples derived respectively from the source speaker and the target speaker. Referring again to FIG. 2, the light curves in each codebook entry represent the (male) source speaker's voice and the dark curves in each codebook entry represent the (female) target speaker's voice.

CONVERTING SPEECH

Figure 3:
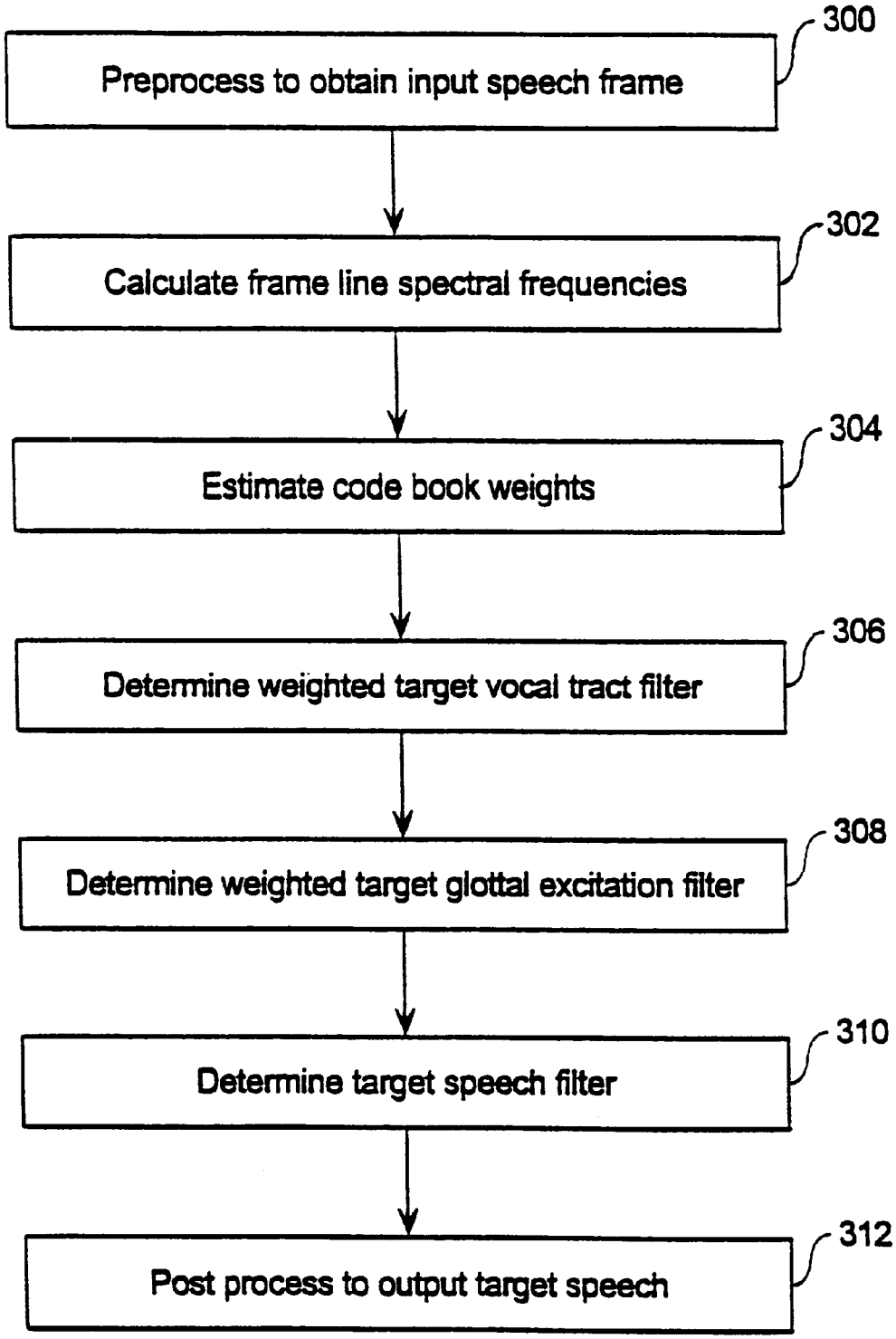
FIG. 3 is a flowchart illustrating the operation of voice conversion according to an embodiment of the present invention.

When the appropriate codebooks for the source and target speakers have been prepared, input speech in the source voice is transformed into the voice of the target speaker, according to one embodiment of the present invention, by performing the steps illustrated in FIG. 3. In step 300, the input speech is preprocessed to obtain an input speech frame. More specifically, the input speech is sampled at an appropriate frequency such as 16 kHz, and the DC bias is removed as by mean removal. The sampled signal is also windowed to produce the input speech frame x(n)=w(n)s(n), where w(n) is a data windowing function providing a raised cosine window, e.g. a Hamming window or a Hanning window, or other window such a rectangular window or a center-weighted window.

In step 302, the input speech frame is converted into line spectral frequency format. According to one embodiment of the present invention, a linear predictive coding analysis is first performed to determine the predication coefficients $a_k$ for the input speech frame. The linear predictive coding analysis is of an appropriate order, for example, from an $14^{th}$ order to a $30^{th}$ order analysis, such as an $18^{th}$ order or $20^{th}$ order analysis. Based on the predication coefficients $a_k$, a line spectral frequency vector $w_k$ is derived, as by the use of polynomials P(z) and Q(z), explained in more detail herein above.

CODEBOOK WEIGHTS

Conventional voice conversions by codebook methodologies suffer from loss of information due to matching only to a single, "closest" source phone. Consequently, artifacts may be introduced at speech fame boundaries, leading to rough transitions from one frame to the next. Accordingly, one embodiment of the invention matches the incoming speech frame to a weighted average of a plurality of codebook entries rather than to a single codebook entry. The weighting of codebook entries preferably reflects perceptual criteria. Use of a plurality of codebook entries smoothes the transition between speech frames and captures the vocal nuances between related sounds in the target speech output. Thus, in step 304, codebook weights $v_i$ are estimated by comparing the input line spectral frequency vector $w_k$ with each centroid vector $S_i$ in the source codebook to calculate a corresponding distance $d_i$:

$$d_i = \sum_{k=1}^{P} h_k |w_k - S_{ik}|,\ i \in 1 \ldots L \tag{3}$$

where L is the codebook size. The distance calculation includes a weight factor $h_k$, which is based on a perceptual criterion wherein closely spaced line spectral frequency pairs, which are likely to correspond to formant locations, are assigned higher weights:

$$h_k = \frac{e^{-0.05|K-k|}}{\min(|w_k - w_{k-1}|, |w_k - w_{k+1}|)},\ k \in 1 \ldots P \tag{4}$$

where K is 3 for voiced sounds and 6 for unvoiced, since the average energy decreases (for voiced sounds) and increases (for unvoiced sounds) with increasing frequency. Based on the calculated distances $d_i$, the normalized codebook weights $v_i$ are obtained as follows:

$$v_i = \frac{e^{-\gamma d_l}}{\sum_{l=1}^{L} e^{-\gamma d_l}},\ i \in 1 \ldots L \tag{5}$$

where the value of $\gamma$ for each frame is found by an incremental search in the range of 0.2 to 2:0 with the criterion of minimizing the perceptual weighted distance between the approximated line spectral frequency vector $vS_k$ and the input line spectral frequency vector $w_k$.

CODEBOOK WEIGHT REFINEMENT

Figure 4:
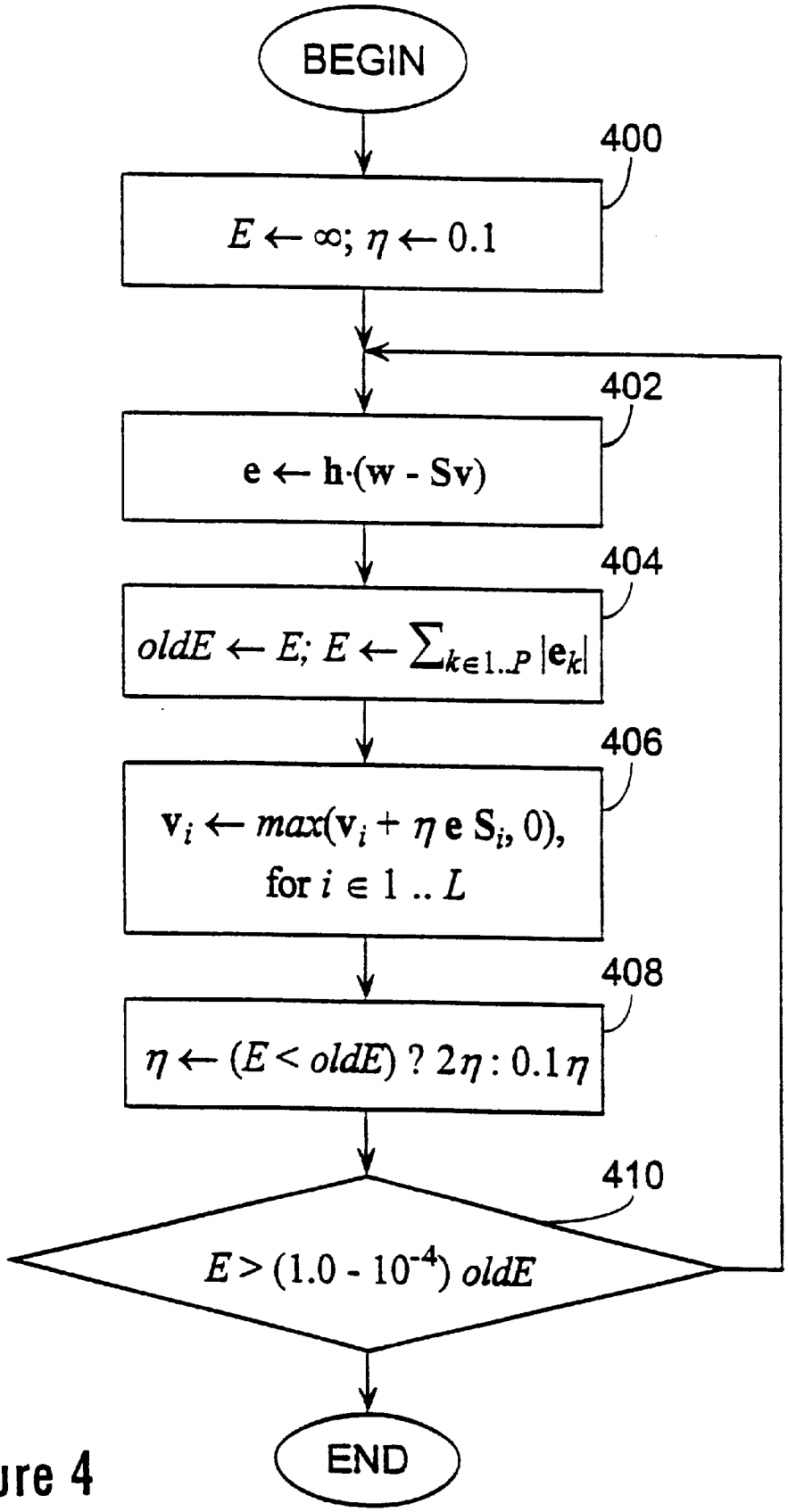
FIG. 4 is a flowchart illustrating the operation of refining codebook weight by a gradient descent analysis according to an embodiment of the present invention.

In some applications, even the normalized codebook weights $v_i$ may not be an optimal set of weights that would represent the original speech spectrum. According to one embodiment of the present invention, a gradient descent analysis is performed to improve the estimated codebook weights $v_i$. Referring to the flowchart illustrated in FIG. 4, one implementation of a gradient descent analysis comprises an initialization step 400 wherein an error value E is initialized to a very high number and a convergence constant $\eta$ is initialized to a suitable value from 0.05 to 0.5 such as 0.1.

In the main loop of the gradient descent analysis, starting at step 402, an error vector e is calculated based on the distance between the approximated line spectral frequency vector vS and the input line spectral frequency vector w and weighted by the height factor h. In step 404, the error value E is saved in an old error variable oldE and new error value E is calculated from the error vector e, for example, by a sum of the absolute values or by a sum of squares. In step 406, the codebook weights $v_i$ are updated by an addition of the error with respect to the source codebook vector eS, factored by the convergence constant $\eta$ and constrained to be positive to prevent unrealistic estimates. In order to reduce computation according to one embodiment of the present invention, the convergence constant $\eta$ is adjusted based on the reduction in error. Specifically, if there is a reduction in error, the convergence constant $\eta$ is increased, otherwise it is decreased (step 408). The main loop is repeated until the reduction in error fall below an appropriate threshold, such as one part in ten thousand (step 410).

It is observed that only a few codebook entries are assigned significantly large weight values in the initial weight vector estimate v. Therefore, one embodiment of the present invention, in order to save computation resources, updates the weights v in step 406 only on the first few largest weights, e.g. on the five largest weights. Use of this gradient descent method has resulted in an additional 15% reduction in the average Itakura-Saito distance between the original spectra $w_k$ and the approximated spectra $vS_k$. The average spectral distortion (SD), which is a common spectral quantizer performance evaluation, was also reduced from 1.8 dB to 1.4 dB.

VOCAL TRACT SPECTRUM MAPPING

Referring back to FIG. 3, in step 306, a target vocal tract filter $V_t(\omega)$ is calculated as a weighted average of the entries in the target codebook to represent the voice of the target speaker for the current speech frame. According to an embodiment of the present invention, the refined codebook weights $v_i$ are applied to the target line spectral frequency vectors $T_i$ to construct the target line spectral frequency vector $vT_k$:

$$\tilde{w}_k = \sum v_i T_{ik},\ k \in 1 \ldots P \tag{7}$$

The target line spectral frequencies are then converted into target linear prediction coefficients $\bar{a}_k$, for example by way of polynomials P(z) and Q(z). The target linear prediction coefficients $a_k$ are in turn used to estimate the target vocal tract filter $V_t(\omega)$:

$$V_t(\omega) = \left| \frac{1}{1 - \sum_{k=1}^{P} \tilde{a}_k e^{-jk\omega}} \right|^{\beta}, \tag{8}$$

where $\beta$ should theoretically be 0.5. The averaging of line spectral frequencies, however, often results in formants, or spectral peaks, with larger bandwidths, which is heard as a buzz artifact. One approach in addressing this problem is to increase the value $\beta$, which adjusts the dynamic range of the spectrum and, hence, reduce the bandwidths of the formant frequencies. One disadvantage with increasing $\beta$, however, is that the bandwidth is reduced also in other frequency bands besides the formant locations, thereby warping the target voice spectrum.

Accordingly, another approach is to reduce the bandwidths of the formants by adjusting the line spectral frequencies directly. The target line spectrum pairs $\overline{w}_i$ and $\overline{w}_{i+1}^{\ j}$ around the first F formant frequency locations $f_j, j \in 1 \ldots F$, are modified, wherein F is set to a small integer such as four (4). The source formant bandwidths $b_j$ and the target formant bandwidths $\overline{b}_j$ are used to estimate a bandwidth adjustment ratio, r:

$$r = \frac{\sum_{j=1}^{F} b_j}{\sum_{j=1}^{F} \tilde{b}_j} \tag{9}$$

Accordingly, each pair of target line spectrum $\overline{w}_i^{\ j}$ and $\overline{w}_{i+1}^{\ j}$ around corresponding formant frequency location $f_j$ is adjusted as follows:

$$\overline{w}_i^{\ j} \rightarrow \tilde{w}_i^{\ j} + (1-r)(f_j - \tilde{w}_i^{\ j}), j \in 1 \ldots F \tag{10}$$

and $$\overline{w}_{i+1}^{\ j} \leftarrow \tilde{w}_{i+1}^{\ j} + (1-r)(f_j - \tilde{w}_{i+1}^{\ j}), j \in 1 \ldots F \tag{11}$$

Figure 5:
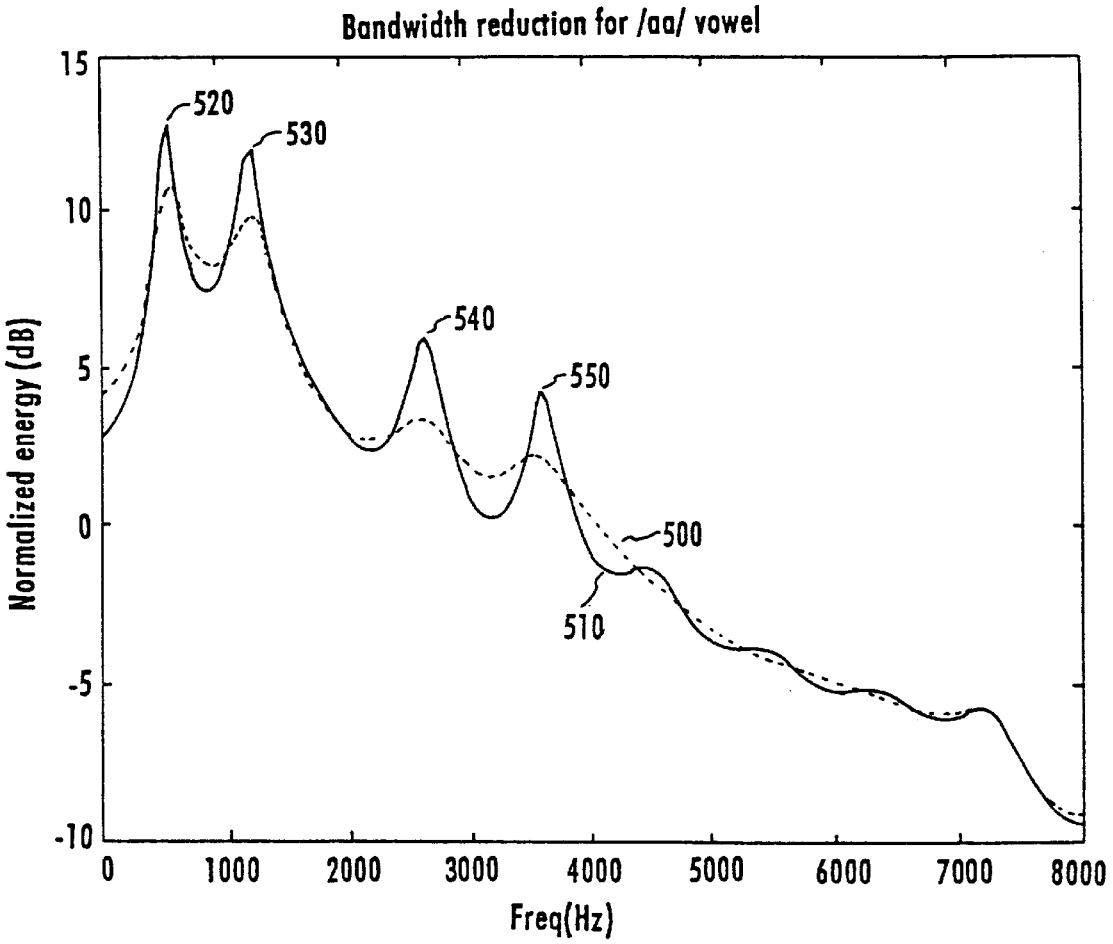
FIG. 5 depicts a bandwidth reduction of formants of a weighted target voice spectrum according to an embodiment of the present invention.

A minimum bandwidth value, e.g. $f_j$/20 Hz or 50 Hz, may be set in order to prevent the estimation of unreasonable bandwidths. FIG. 5 illustrates a comparison of the target speech power spectrum for the [AA] vowel before (light curve 500) and after (dark curve 510) the application of this bandwidth reduction technique. Reduction in the bandwidth of the first four formants 520, 530, 540, and 550, results in higher and more distinct spectral peaks. According to detailed observations and subjective listening tests, use of this bandwidth reduction technique has resulted in improved voice output quality.

EXCITATION CHARACTERISTICS MAPPING

Another factor that influences speaker individuality and, hence, voice conversion quality is excitation characteristics. The excitation can be very different for different phonemes. For example, voiced sounds are excited by a periodic pulse train or "buzz," and unvoiced sounds are excited by white noise or "hiss." According to one embodiment of the present invention, the linear predictive coding residual is used as an approximation of the excitation signal. In particular, the linear predictive coding residuals for each entry in the source codebook and the target codebook are collected as the excitation signals from the training data to compute a corresponding short-time average discrete Fourier analysis or pitch-synchronous magnitude spectrum of the excitation signals. The excitation spectra are used to formulate excitation transformation spectra for entries of the source codebook, $U_i^s(\omega)$, and the target codebook, $U_t^i(\omega)$. Since linear predictive coding is an all-pole model, the formulated excitation transformation filters serve to transform the zeros in the spectrum as well, thereby further improving the quality of the voice conversion.

Referring back to FIG. 3, in step 308, the excitations in the input speech segment are transformed from the source voice to the target voice by the same codebook weights $v_i$ used in transforming the vocal tract characteristics. Specifically, an overall excitation filter is constructed as a weighted combination of the excitation codebook excitation spectra:

$$H_g(\omega) = \sum v_i U_i^t \frac{(\omega)}{U_i^s(\omega)} \tag{12}$$

According to one embodiment of the present invention, the overall excitation filter $H_g(\omega)$ is applied to the linear predictive coding residual e(n) of the input speech signal x(n) to produce a target excitation filter:

$$G_t(\omega) = H_g(\omega) DFT\{e(n)\} \tag{13}$$

where the linear predictive coding residual e(n) is given by:

$$e(n) = x(n) - \sum_{k=1}^{P} a_k x(n-k) \tag{14}$$

Both the vocal tract characteristics and the excitations characteristics are transformed in the same computational framework, by computing a weighted average of codebook entries. Accordingly, this aspect of the present invention enables the incorporation of excitation characteristics within a voice conversion system in a computationally tractable manner.

TARGET SPEECH FILTER

Referring again to FIG. 3, in step 310, a target speech filter $Y(\omega)$ is on the basis of the vocal tract filter $V_t(\omega)$ and, in some embodiments of the present invention, the excitation filter $G_t(\omega)$. According to one embodiment, target speech filter $Y(\omega)$ is defined as the the excitation filter $G_t(\omega)$ followed by the vocal tract filter $V_t(\omega)$:

$$Y(\omega) = G_t(\omega) V_t(\omega). \tag{15}$$

In accordance with another embodiment of the present invention, further refinement to the construction of the target speech filter $Y(\omega)$ may be desirable for improved handling of unvoiced sounds. The incoming speech spectrum $X(\omega)$, derived from the sampled and windowed input speech x(n), can be represented as $$X(\omega) = G_s(\omega) V_s(\omega), \tag{16}$$

where $G_s(\omega)$ and $V_t(\omega)$ represent the source speaker excitation and vocal tract spectrum filters. respectively. Consequently, the target speech spectrum filter $Y(\omega)$ can be formulated as:

$$Y(\omega) = \left[\frac{G_t(\omega)}{G_s(\omega)}\right]\left[\frac{V_t(\omega)}{V_s(\omega)}\right] X(\omega) \tag{17}$$

Using the overall excitation filter $H_g(\omega)$ as an estimate of the excitation filter, the target speech spectrum filter $Y(\omega)$ becomes:

$$Y(\omega) = H_g(\omega)\left[\frac{V_t(\omega)}{V_s(\omega)}\right] X(\omega) \tag{18}$$

When the amount of the training data is small or when the accuracy of the segmentation in question, unvoiced segments are difficult to represent accurately, thereby leading to a mismatch in the source and target vocal tract filters. Accordingly, one embodiment of the present invention, estimates a source speaker vocal tract spectrum filter $V_t(\omega)$ differently for voiced segments and for unvoiced segments. For voiced segments, the source speaker vocal tract spectrum filter $V_t(\omega)$ is replaced with the spectrum derived from the original linear predictive coefficient vector $a_k$:

$$V_s(\omega) = \frac{1}{1 - \sum_{k=1}^{P} a_k e^{-jk\omega}}. \tag{19}$$

On the other hand, the linear predictive vector approximation coefficients, derived from the codebook weighted line spectral frequency vector approximation $vS_k$, is used to determine the source speaker vocal tract spectrum filter $V_s(\omega)$ for unvoiced segments.

In step 312, the result of applying $Y(\omega)$ for the current segment is post processed into a time-domain target signal in the voice of the target speaker. More specifically, an inverse discrete Fourier transform is applied to produce the synthetic target voice:

$$y(n)=Re\{IDFT\{Y(\omega)\}\}. \tag{20}$$

PROSODY TRANSFORMATION

According to one embodiment of the present invention, prosodic transformations may be applied to the frequency domain target voice signal $Y(\omega)$ before post processing into the time domain. Prosodic transformations allow the target voice to match the source voice in pitch, duration, and stress. For example, a pitch scale modification factor $\beta$ at each frame can be set as $$\beta = \frac{\sqrt{\frac{\sigma_1^2}{\sigma_3^2}}\,(f_0 - \mu_s) + \mu_t}{f_0}, \tag{21}$$

where $\sigma_s^2$ is the source pitch variance, $\sigma_t^2$ is the target pitch variance, $f_0$ is the source speaker fundamental frequency, $\mu_s$ is the source mean pitch value, and $\mu_t$ is the target mean pitch value. For duration characteristics, a time-scale modification factor $\gamma$ can be set according to the same codebook weights:

$$\gamma = \sum_{i=1}^{L} v_i \frac{d_i^t}{d_i^s}, \tag{22}$$

where $d_i^s$ is the average source speaker duration and $d_i^t$ is the average target speaker duration. For the speakers' stress characteristics, an energy-scale modification factor $\eta$ can be set according to the same codebook weights:

$$\eta = \sum_{i=1}^{L} v_i \frac{e_i^t}{e_i^s}, \tag{23}$$

where $e_i^s$ is the average source speaker RMS energy and $e_i^t$ is the average target speaker RMS energy.

The pitch-scale modification factor $\beta$, the time-scale modification factor $\gamma$, and the energy scaling factor $\eta$ are applied by an appropriate methodology, such as within a pitch-synchronous overlap-add synthesis framework, to perform the prosodic synthesis. One overlap-add synthesis methodology is explained in more detail in the commonly assigned application Ser. No. 09/355,386, entitled "System and Methodology for Prosody Modification," filed concurrently by Francisco M. Gimenez de los Galenes and David Talkin, the contents of which are herein incorporated by reference.

While this invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims.

What is claimed is:

1. A method of transforming a source signal representing a source voice into a target signal representing a target voice, said method comprising the machine-implemented steps of:

preprocessing said source signal to produce a source signal segment;

comparing the source signal segment with a plurality of source codebook entries representing speech units in said source voice to produce therefrom a plurality of corresponding weights;

transforming the source signal segment into a target signal segment based on the plurality of weights and a plurality of target codebook entries representing speech units in said target voice, said target codebook entries corresponding to the plurality of source codebook entries; and post processing the target signal segment to generate said target signal.

2. A method as in claim 1, wherein the step of preprocessing said source signal includes the step of sampling said source signal to produce a sampled source signal.

3. A method as in claim 2, wherein the step of preprocessing said source signal includes the step of segmenting said sampled source signal to produce the source signal segment.

4. A method as in claim 1, wherein the step of comparing the source signal segment to produce therefrom a plurality of corresponding weights includes the step of comparing the source signal segment to produce therefrom a plurality of corresponding perceptual weights.

5. A method as in claim 1, wherein the step of comparing the source signal segment includes the steps of:

converting the source signal segment into a plurality of line spectral frequencies; and comparing the plurality of line spectral frequencies with the plurality of the source code entries to produce therefrom the plurality of the respective weights, wherein each of the source code entries include a respective plurality of line spectral frequencies.

6. A method as in claim 5, wherein the step of converting the source signal segment includes the steps of:

determining a plurality of coefficients for the source signal segment; and converting the plurality of coefficients into the plurality of line spectral frequencies.

7. A method as in claim 6, wherein the step of determining a plurality of coefficients includes the step of determining a plurality of linear prediction coefficients or PARCOR coefficients.

8. A method as in claim 5, wherein the step of comparing the plurality of line spectral frequencies includes the steps of:

computing a plurality of distances between the source signal segment, represented by the plurality of line spectral frequencies, and each of the plurality of the respective source code entries, represented by a respective plurality of line spectral frequencies; and producing the plurality of the weights based on the plurality of respective distances.

9. A method as in claim 8, further including the step of refining the plurality of weights by a gradient descent method.

10. A method as in claim 1, wherein the step of transforming the source signal segment into a target signal segment based on the plurality of weights and a plurality of target codebook entries includes the step of transforming vocal tract characteristics of the source signal segment into the target signal segment based on the plurality of weights and a plurality of target codebook entries.

11. A method as in claim 10, wherein the step of transforming vocal tract characteristics includes the step of reducing formant bandwidths in the target signal segment.

12. A method as in claim 10, wherein the step of transforming the source signal segment into a target signal segment based on the plurality of weights and a plurality of target codebook entries includes the step of transforming excitation characteristics of the source signal segment into the target signal segment based on the plurality of weights.

13. A method as in claim 1, further including the step of modifying the prosody of the target signal segment based on the plurality of weights.

14. A method as in claim 13, wherein the step of modifying the prosody of the target signal segment based on the plurality of weights includes the step of modifying the duration of the target signal segment.

15. A method as in claim 13, wherein the step of modifying the prosody of the target signal segment based on the plurality of weights includes the step of modifying the stress of the target signal segment.

16. A computer-readable medium bearing instructions for transforming a source signal representing a source voice into a target signal representing a target voice, said instructions arranged, when executed, to cause one or more processors to perform the steps of:

preprocessing said source signal to produce a source signal segment;

comparing the source signal segment with a plurality of source codebook entries representing speech units in said source voice to produce therefrom a plurality of corresponding weights;

transforming the source signal segment into a target signal segment based on the plurality of weights and a plurality of target codebook entries representing speech units in said target voice, said target codebook entries corresponding to the plurality of source codebook entries; and post processing the target signal segment to generate said target signal.

17. A computer-readable medium as in claim 16, wherein the step of preprocessing said source signal includes the step of sampling said source signal to produce a sampled source signal.

18. A computer-readable medium as in claim 17, wherein the step of preprocessing said source signal includes the step of segmenting said sampled source signal to produce the source signal segment.

19. A method as in claim 16, wherein the step of comparing the source signal segment to produce therefrom a plurality of corresponding weights includes the step of comparing the source signal segment to produce therefrom a plurality of corresponding perceptual weights.

20. A computer-readable medium as in claim 16, wherein the step of comparing the source signal segment includes the steps of:

converting the source signal segment into a plurality of line spectral frequencies; and comparing the plurality of line spectral frequencies with the plurality of the source code entries to produce therefrom the plurality of the respective weights, wherein each of the source code entries include a respective plurality of line spectral frequencies.

21. A computer-readable medium as in claim 20, wherein the step of converting the source signal segment includes the steps of:

determining a plurality of coefficients for the source signal segment; and converting the plurality of coefficients into the plurality of line spectral frequencies.

22. A computer-readable medium as in claim 21, wherein the step of determining a plurality of coefficients includes the step of determining a plurality of linear prediction coefficients or PARCOR coefficients.

23. A computer-readable medium as in claim 20, wherein the step of comparing the plurality of line spectral frequencies includes the steps of:

computing a plurality of distances between the source signal segment, represented by the plurality of line spectral frequencies, and each of the plurality of the respective source code entries, represented by a respective plurality of line spectral frequencies; and producing the plurality of the weights based on the plurality of respective distances.

24. A computer-readable medium as in claim 23, further including the step of refining the plurality of the weight by a gradient descent method.

25. A computer-readable medium as in claim 16, wherein the step of transforming the source signal segment into a target signal segment based on the plurality of weights and a plurality of target codebook entries includes the step of transforming vocal tract characteristics of the source signal segment into the target signal segment based on the plurality of weights and a plurality of target codebook entries.

26. A computer-readable medium as in claim 25, wherein the step of transforming vocal tract characteristics includes the step of reducing formant bandwidths in the target signal segment.

27. A computer-readable medium as in claim 25, wherein the step of transforming the source signal segment into a target signal segment based on the plurality of weights and a plurality of target codebook entries includes the step of transforming excitation characteristics of the source signal segment into the target signal segment based on the plurality of weights.

28. A computer-readable medium as in claim 16, wherein the instructions, when executed, are further arranged to perform the step of modifying the prosody of the target signal segment based on the plurality of weights.

29. A computer-readable medium as in claim 28, wherein the step of modifying the prosody of the target signal segment based on the plurality of weights includes the step of modifying the duration of the target signal segment.

30. A computer-readable medium as in claim 28, wherein the step of modifying the prosody of the target signal segment based on the plurality of weights includes the step of modifying the stress of the target signal segment.

* * * * *

UNITED STATES PATENT AND TRADEMARK OFFICE

CERTIFICATE OF CORRECTION

PATENT NO. : 6,615,174 B1
DATED : September 2, 2003
INVENTOR(S) : Arslan et al.

It is certified that error appears in the above-identified patent and that said Letters Patent is hereby corrected as shown below:

Column 7,
Line 16, "fame" should be -- frame --
Line 56, "2:0" should be -- 2.0 --

Column 8,
Lines 48 and 51, "$\bar{a}_k$" should be -- $\tilde{a}_k$ --
Line 62, after "value" insert -- of --

Column 9,
Lines 3 and 18-19, "$\bar{w}_i$ and $\bar{w}_{i+1^j}$" should be -- $\tilde{w}_i$ and $\tilde{w}_{i+1^j}$ --
Line 7, "$\bar{b}_j$" should read -- $\tilde{b}_j$ --
Line 56, "$U_t^i(\omega)$" should read -- $U_i^t(\omega)$ --

Column 10,
Lines 42, 63 and 66, "$V_t(\omega)$" should be -- $V_s(\omega)$ --

Column 9,
Line 21, equation 10, "$\bar{w}_i^j \rightarrow \bar{w}_i + (1-r)(f_j - \bar{w}_i^j), j \in 1...F$" should be
-- $\tilde{w}_i^j \leftarrow \tilde{w}_i + (1-r)(f_j - \tilde{w}_i^j), j \in 1...F$ --

Line 25, equation 11, "$\bar{w}_{i+1^j} \leftarrow \bar{w}_{i+1^j} + (1-r)(f_j - \bar{w}_{i+1^j}), j \in 1...F$" should be
-- $\tilde{w}_{i+1}^j \leftarrow \tilde{w}_{i+1}^j + (1-r)f_j - \tilde{w}_{i+1}^j), j \in 1...F$ --

Column 10,
Line 3, equation 12, "$H_g(\omega) = \sum v_i U_i^t \frac{(\omega)}{U_i^s(\omega)}$" should be -- $H_g(\omega) = \sum v_i \frac{U_i^t(\omega)}{U_i^s(\omega)}$ --

UNITED STATES PATENT AND TRADEMARK OFFICE

CERTIFICATE OF CORRECTION

PATENT NO. : 6,615,174 B1
DATED : September 2, 2003
INVENTOR(S) : Arslan et al.

It is certified that error appears in the above-identified patent and that said Letters Patent is hereby corrected as shown below:

Column 11,

Line 30, " $\beta = \dfrac{\sqrt{\dfrac{\sigma_1^2}{\sigma_3^2}(f_0 - \mu_s) + \mu_t}}{f_0}$ "

should be -- $\beta = \dfrac{\sqrt{\dfrac{\sigma_t^2}{\sigma_s^2}(f_0 - \mu_s) + \mu_t}}{f_0}$ --

Signed and Sealed this

Thirty-first Day of August, 2004

JON W. DUDAS
*Director of the United States Patent and Trademark Office*